United States Patent [19]

Le Dain et al.

[11] Patent Number: 4,677,399

[45] Date of Patent: Jun. 30, 1987

[54] WIDE BAND DIRECTIONAL COUPLER FOR MICROSTRIP LINES

[75] Inventors: René Le Dain; Henri Havot, both of Cesson Sevigne, France

[73] Assignees: Etat Francais represente par le Ministre des PTT (Centre National d'Etudes des Telecommunications), Issy les Moulineaux; Etablissement Public de Telediffusion dit "Telediffusion de France", Montrouge, both of France

[21] Appl. No.: 855,619

[22] Filed: Apr. 25, 1986

[30] Foreign Application Priority Data

Apr. 26, 1985 [FR] France ..... 85 06422

[51] Int. Cl.[4] ..... H01P 5/18

[52] U.S. Cl. ..... 333/116; 333/246

[58] Field of Search ..... 333/115, 116

[56] References Cited

U.S. PATENT DOCUMENTS

| | | | |
|---|---|---|---|
| 3,315,182 | 4/1967 | Woolley, Jr. | 333/115 |
| 4,139,827 | 2/1979 | Russell | 333/116 |
| 4,178,568 | 12/1979 | Gunton | 333/116 |
| 4,185,258 | 1/1980 | Cote et al. | 333/116 X |
| 4,216,446 | 8/1980 | Iwer | 333/116 X |

*Primary Examiner*—Paul Gensler

*Attorney, Agent, or Firm*—Fleit, Jacobson, Cohn & Price

[57] ABSTRACT

A wide band directional coupler for microstrip lines has a microstrip line section whose conductive core is coupled to the core of the main line over a length λ/4 (λ being the wave length in a mid portion of the desired pass band). The section has a first fraction parallel to the main line and at a small distance therefrom so as to provide tight coupling and a second fraction diverging from the main line and closed on a matching impedance. The free end of the first fraction is connected to the load and has an extension projecting over a length less than λ/16 for forming a microcapacitor tapping energy from the main line.

8 Claims, 3 Drawing Figures

WIDE BAND DIRECTIONAL COUPLER FOR MICROSTRIP LINES

BACKGROUND OF THE INVENTION

The invention relates to directional couplers for diverting or distributing very high frequency signals, the transmission of which requires the use of microstrip lines.

Couplers are known for microstrip lines. Most have a narrow pass band and low directivity, for example 12 dB over 1 or 2 octaves, and/or high losses, this latter case being particularly that of distributors which use resistors. Now, there are applications which require a coupler usable in a very wide frequency band and having a high directivity. Examples of such couplers are those for community antennae and for teledistribution networks, for which it is anticipated that the frequencies will develop towards higher values. In practice, there is a need for a coupler capable of operating in a frequency range extending over more than 5 octaves and having a high directivity.

French 2,276,705 describes a coupler for a strip line formed by a strip line section whose core or conductor is locally close to the core of the main line; such a coupler is not adapted to sufficient directivity in a wide frequency range.

Another prior art directional coupler for a microstrip line (German 2,658,364) comprises two parallel coupled lines extended by elements forming capacitors and replaceable by discrete components. Thus improvement in directivity is obtained but without appreciably increasing the pass band.

According to U.S. Pat. No. 3,416,102 (Hamlin), a coupler for tapping a coaxial cable may have a wire section which, over part of its length, is parallel to the central conductor of the coaxial cable and is in contact therewith. An end portion at least of the take-off section may be at an oblique angle so as to facilitate insertion of the section. The obliqueness of the insertion hole has no other purpose.

There exists no relationship between the latter coupler and those concerned by the invention. Their modes of propagation are entirely different: in one case, there is a coaxial structure which it is desired to modify as little as possible so as to avoid impairing the propagation conditions and the performances, whereas in the other, there is a disymmetric structure (microstrip conductor and mass plane) whose performances are improved. In one case, we have a homogeneous or substantially homogeneous dielectric and in the other case we have a non homogeneous dielectric, formed of two elements (substrate and air).

SUMMARY OF THE INVENTION

It is an object of the invention to provide a coupler for microstrip lines having low losses and high directivity, thus allowing several couplers to be mounted in cascade without excessively penalizing the spatial range, and that within a high frequency range, while remaining of low manufacturing cost.

To this end, there is provided a directional coupler comprising a microstrip line section whose conductive core is coupled to that of the main line over a length substantially equal to $\lambda/4$, $\lambda$ being the wave length in a median part of the pass band, said section having a first fraction parallel to the main line and at a small distance therefrom so as to provide tight coupling and a second fraction diverging from the line and closed on a characteristic impedance, the free end of the first fraction being connected to the load and this first fraction projecting beyond an output by less than $\lambda/16$ and forming a microcapacitor taking off energy from the main line. The above-mentioned distance will typically be of the same order as the width of the microstrip core.

The microcapacitor extension, whose distance from the line will be substantially equal to that of the first fraction, gives the coupler high directivity.

In practice, a coupler of the above-defined type may be constructed to operate in a frequency range of from 40 MHz to 2000 MHz and is capable of accepting all TV and radio signals at the frequencies scheduled for teledistribution: it is suitable for direct distribution at the first intermediate frequency standardized for use in the TV sets direct satellite broadcasting.

The second fraction will typically be rectilinear section and will be at a constant angle with the main line.

The constant coupling of the first fraction will as a general rule be less than 10 dB. The frequency response curve of the coupler may be patterned by modifying the ratio of the lengths of the two fractions. It will in particular be possible to provide preaccentuation compensating for the characteristic of the main line. The section may have a total length corresponding to $\lambda/4$, $\lambda$ being the wave length for a frequency of 460 MHz.

The invention will be better understood from the following description of embodiments given by way of examples.

SHORT DESCRIPTION OF THE DRAWINGS

Figure 1:
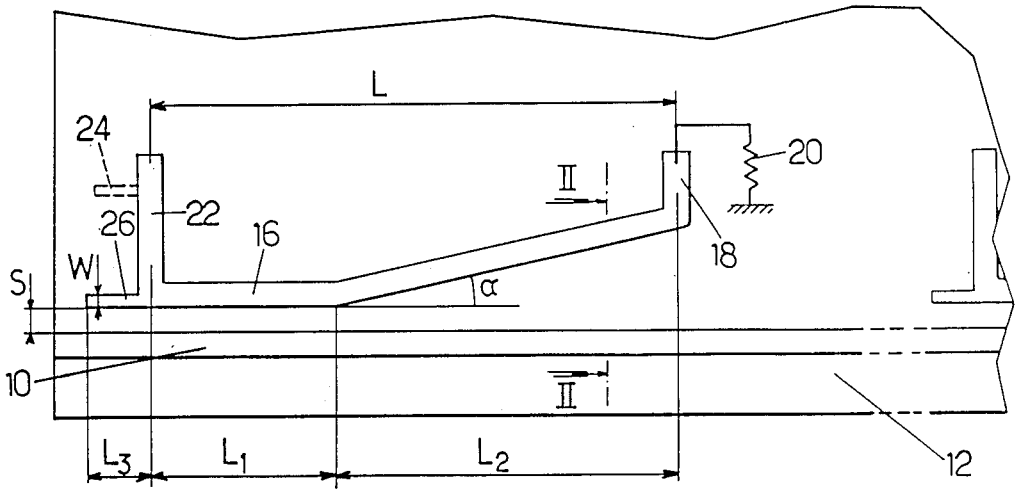
FIG. 1 is a schematic representation of a coupler according to the invention, showing a fraction of a second coupler, as seen from above.
Figure 3:
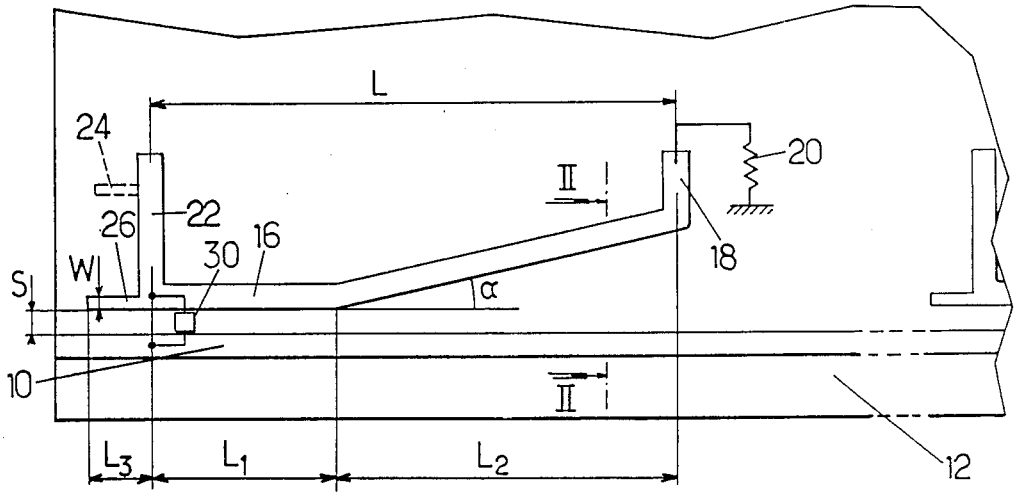

FIG. 3, similar to FIG. 1, shows a modification.

DETAILED DESCRIPTION OF A PREFERRED EMBODIMENT

Figure 2:
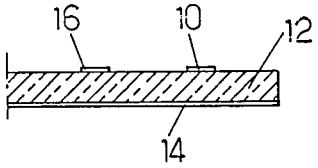
FIG. 2 is a sectional view through line II—II of FIG. 1.

The coupler which will be described by way of example is of a type which may be used for distributing or diverting signals in a frequency range which may exceed 5 octaves with high directivity and low losses. The coupler is for tapping energy from a microstrip line conductive core 10. This line is formed on an insulating substrate 12 whose lower face is covered with a conducting layer 14 (FIG. 2). Substrate 12 may be of resin (epoxy resin for example) reinforced, for example with glass fibers; the manufacturing process may be similar to that of printed circuits.

As shown in FIG. 1, the coupler comprises a microstrip line section formed on substrate 12. This section comprises a core 16 having a first fraction, of length L1, parallel to core 10 and at a small distance therefrom for providing tight coupling, and a second fraction, of length L2, diverging from the line and usually rectilinear. In a coupler constructed to operate in a 40–2000 MHz band, the angle $\alpha$ of the two fractions will not generally exceed 10° since, beyond that value, the coupling is not satisfactory any longer. The free end of the second fraction is provided with an output 18 closed on a matched impedance 20 (characteristic impedance of the line section 16). The other end of the section has an output 22, which forms the output of the derivating device. It is possible to provide at output 22 a metallized compensation element 24 for adjusting the standing wave ratio.

The coupler further comprises a microcapacitor placed in the extension of the first fraction 16, beyond the output 22. The microcapacitor is formed by a microstrip element 26 of length L3. The microcapacitor thus formed, placed upstream of the coupling zone in the direction of propagation, takes energy from the core line 10, but does not participate (at least in the lower part of the pass band) in the coupling.

The microstrip line section of the coupler will have a total length L such that:

$$L = (\lambda/4)/\sqrt{\epsilon}$$

where $\lambda$ is the wave length in air corresponding to a predetermined frequency within the desired pass band and $\epsilon$ is the dielectric constant of the substrate.

The response curve may be patterned by adjusting the ratio of lengths L1 and L2. The angle between the second fraction and the main line may also vary but will as a general rule remain much lesser than 45°.

Starting from the distance between core 10 and section 16, the thickness of the substrate and the width of section 16 the different coupling values C may be computed:

$$C=(Z_{oe}-Z_{oo})/(Z_{oe}+Z_{oo})$$

where $Z_{oe}$ and $Z_{oo}$ are the matching impedances in even mode and odd mode, respectively.

The length L3 of element 26 must remain less than $\lambda/16$ so as not to disturb operation of the main line. Length L3 and spacing S (FIG. 1) are the main parameters determining the influence of element 26: they will be experimentally adjusted since $L3<\lambda/16$ and S is almost equal to the distance between 10 and 16. The width W of element 26 on the other hand has no appreciable influence on the directivity and will be selected depending on the load connected to output 22, since it influences the output impedance. With that arrangement which has just been described, a pass band may readily be obtained exceeding 5 octaves and a directivity over the whole of the pass band which may vary between 20 and 12 dB (the directivity being the ratio of the power outputs at 22 and at 18). Element 26 has the same thickness as cores 10 and 16.

In the modified embodiment shown in FIG. 3, the performances of the coupler are further increased by adding an impedance 20 between core 10 and section 16, at the level of output 22. The value Z of impedance 30 is selected depending on the amount of coupling which is desired in the lower frequency range. It does not modify circulation in the balance of the pass band if high enough: a resistor of from 750 to 1000 Ohms has given satisfactory results for the above-mentioned pass band. It may be in the form of a discrete component or be integrated as a layer on the substrate.

I claim:

1. Wide band directional coupler for a microstrip line, comprising a microstrip line portion having a conductive core and a microstrip section having a conductive core, the core of said microstrip section being coupled to the core of said microstrip line over a length substantially equal to $\lambda/4$, $\lambda$ being the wave length in a median part of said wide band and said microstrip section having a first fraction parallel to the microstrip line and at a small distance therefrom so as to provide tight coupling and a second fraction diverging from the microstrip line and closed on a matched impedance, the free end of the first fraction having a transversal output for connection to a load and having an extension projecting beyond said output by less than $\lambda/16$ and forming a microcapacitor taking off energy from the microstrip line.

2. Coupler as claimed in claim 1, wherein the second fraction is rectilinear and at a constant angle with the main line.

3. Coupler as claimed in claim 2, wherein said angle is lesser than 45°.

4. Coupler according to claim 1, further comprising a resistor connected between points of said cores in close proximity to said output.

5. Wide band directional coupler for operation substantially within the 40–2000 MHz range, comprising: a microstrip line portion having a conductive core and a microstrip section having a conductive core, the core of said microstrip section being coupled to the core of said microstrip line over a length substantially equal to $\lambda/4$, $\lambda$ being the wave length at 460 MHz and said microstrip section having a first fraction parallel to the microstrip line and at a small distance therefrom so as to provide tight coupling and a second fraction diverging from the microstrip line and closed on a matched impedance, the free end of the first fraction having a transversal output for connection to a load and having an extension projecting beyond said output by less than $\lambda/16$ and forming a microcapacitor taking off energy from the microstrip line.

6. Coupler according to claim 5, wherein said first fraction has a coupling with said microstrip line lower than 10 dB.

7. Coupler according to claim 5, wherein said extension has a conductive core having the same thickness as the core of said microstrip section.

8. Coupler according to claim 5, further comprising a resistor of from 750 to 1000 Ohms connected between points of said cores in close proximity to said output.

* * * * *